US006460185B1

(12) United States Patent
Hardy

(10) Patent No.: US 6,460,185 B1
(45) Date of Patent: Oct. 8, 2002

(54) TREE LEAF CAMOUFLAGE SUIT

(75) Inventor: Phil Hardy, South-Bolton (CA)

(73) Assignee: L.W.L. Outerwear Manufacturers Ltd., Marieville (CA)

( * ) Notice: Subject to any disclaimer, the term of this patent is extended or adjusted under 35 U.S.C. 154(b) by 0 days.

(21) Appl. No.: 09/887,825

(22) Filed: Jun. 22, 2001

(30) Foreign Application Priority Data

Apr. 19, 2001 (CA) ..... 2344726

(51) Int. Cl.[7] ..... A41B 13/00
(52) U.S. Cl. ..... 2/69; 2/79; 2/900
(58) Field of Search ..... 2/69, 79, 108, 2/949 S, 85, 1, 4, 900, 244, 246; 428/15, 16, 17, 18, 24, 25, 26, 27, 919; 40/586

(56) References Cited

U.S. PATENT DOCUMENTS

| | | | | |
|---|---|---|---|---|
| 2,744,348 A | | 5/1956 | Smith | |
| 4,517,230 A | * | 5/1985 | Crawford | 428/17 |
| 4,792,471 A | * | 12/1988 | Lee | 428/17 |
| 5,010,589 A | * | 4/1991 | Hamilton | 2/1 |
| 5,159,718 A | | 11/1992 | Moyer | |
| 5,203,033 A | * | 4/1993 | Sheppard, Sr. et al. | 2/69 |
| 5,274,848 A | * | 1/1994 | Shamblin | 2/69 |
| 5,347,659 A | * | 9/1994 | Tibljas | 428/919 |
| 5,416,928 A | * | 5/1995 | Koenig | 2/244 |
| 5,773,101 A | * | 6/1998 | Sanders | 428/17 |
| 5,901,372 A | | 5/1999 | Lawler | |
| 5,920,903 A | * | 7/1999 | Koehntop et al. | 2/69 |
| 5,958,526 A | * | 9/1999 | Spickelmire | 428/17 |
| 6,060,142 A | * | 5/2000 | Rossini | 428/919 X |

FOREIGN PATENT DOCUMENTS

CA 2020632 7/1990

OTHER PUBLICATIONS

Cabela's MasterCatalog, Fall 1998, p. 50–51.*
Red Head, Fall 1999, Specialists Catalog, p. 17.*

* cited by examiner

*Primary Examiner*—Gloria M. Hale
(74) *Attorney, Agent, or Firm*—Francis C. Hand; Carella, Byrne, Bain et al

(57) ABSTRACT

In combination, an outer garment and a three dimensional camouflage covering for all or a part of the outer garment, the three dimensional camouflage covering comprising an open mesh net base and a plurality of leaf or foliage appendages, in leaf or foliage simulating colour and shape secured thereto, means secured to peripheral portions of the three dimensional covering and to portions of the outer garment releasably to secure the three dimensional covering onto the outer garment in operable fashion.

11 Claims, 2 Drawing Sheets

TREE LEAF CAMOUFLAGE SUIT

BACKGROUND OF THE INVENTION

The present invention relates to an outerwear garment which is convertible to a three dimensional camouflage garment.

Three dimensional camouflaged garments, of the type used by hunters, having an open mesh net base and a plurality of leaf or foliage appendages which simulate leaves or foliage in colour and shape, being secured thereto, are well known. Such a camouflage construction is described and illustrated for example in Leonard Canadian Patent No. 2,020,632 issued Sept. 14, 1999. Other camouflage garment constructions of general background interest are described and illustrated in Smith U.S. Pat. No. 2,744,348 issued May 8, 1956, Shepard et al U.S. Pat. No. 5,203,033 issued Apr. 20, 1993, Moyer U.S. Pat. No. 5,159,718 issued Nov. 3, 1992, Lee U.S. Pat. No. 4,792,471 issued Dec. 20, 1988, Weber et al U.S. Pat. No. 5,695,835 issued Dec. 9, 1997, Crawford U.S. Pat. No. 4,517,230 issued May 14, 1985, Shamblin U.S. Pat. No. 5,274,848 issued Jan. 4, 1994, Specklemire U.S. Pat. No. 5,958,526 issued Sept. 28, 1999, Sanders U.S. Pat. No. 5,773,101 issued Jun. 30, 1998, Rossini U.S. Pat. No. 6,060,142 issued May 9, 2000 and Lawler U.S. Pat. No. 5,901,372 issued May 11, 1999. In most of these prior art constructions, either individual pieces of camouflage must be meticulously fastened to the under garment, or else the garment is permanently made in three dimensional form (e.g. Sanders U.S. Pat. No. 5,773,101 and Webber U.S. Pat. No. 5,695,835).

It is an object of the present invention to provide a simple but effective construction of garment which allows simple versatility by enabling the wearer to readily convert it to a three dimensional camouflage type garment or a conventional "two dimensional" garment.

SUMMARY OF THE INVENTION

In accordance with the present invention there is provided, in combination, an outer garment and a three dimensional camouflage covering for all or a part of the outer garment. The three dimensional covering comprises an open mesh net base and a plurality of leaf or foliage appendages, in leaf or foliage simulating colour and shape secured thereto. Means are secured to peripheral portions of the three dimensional covering and to portions of the outer garment releasably to releasably attach the three dimensional covering onto the outer garment in operable fashion.

As will be described in more detail subsequently, the garment may be in the form of a hooded or non hooded jacket, or pants, or both. The garment according to the present invention is thus readily convertible to either three dimensional camouflage form, by the attachment of the three dimensional covering over the outer garment, or to a conventional outer garment by removing the three dimensional covering.

BRIEF DESCRIPTION OF THE DRAWINGS

These and other advantages of the invention will become apparent upon reading the following detailed description and upon referring to the drawings in which.

Figure 1:
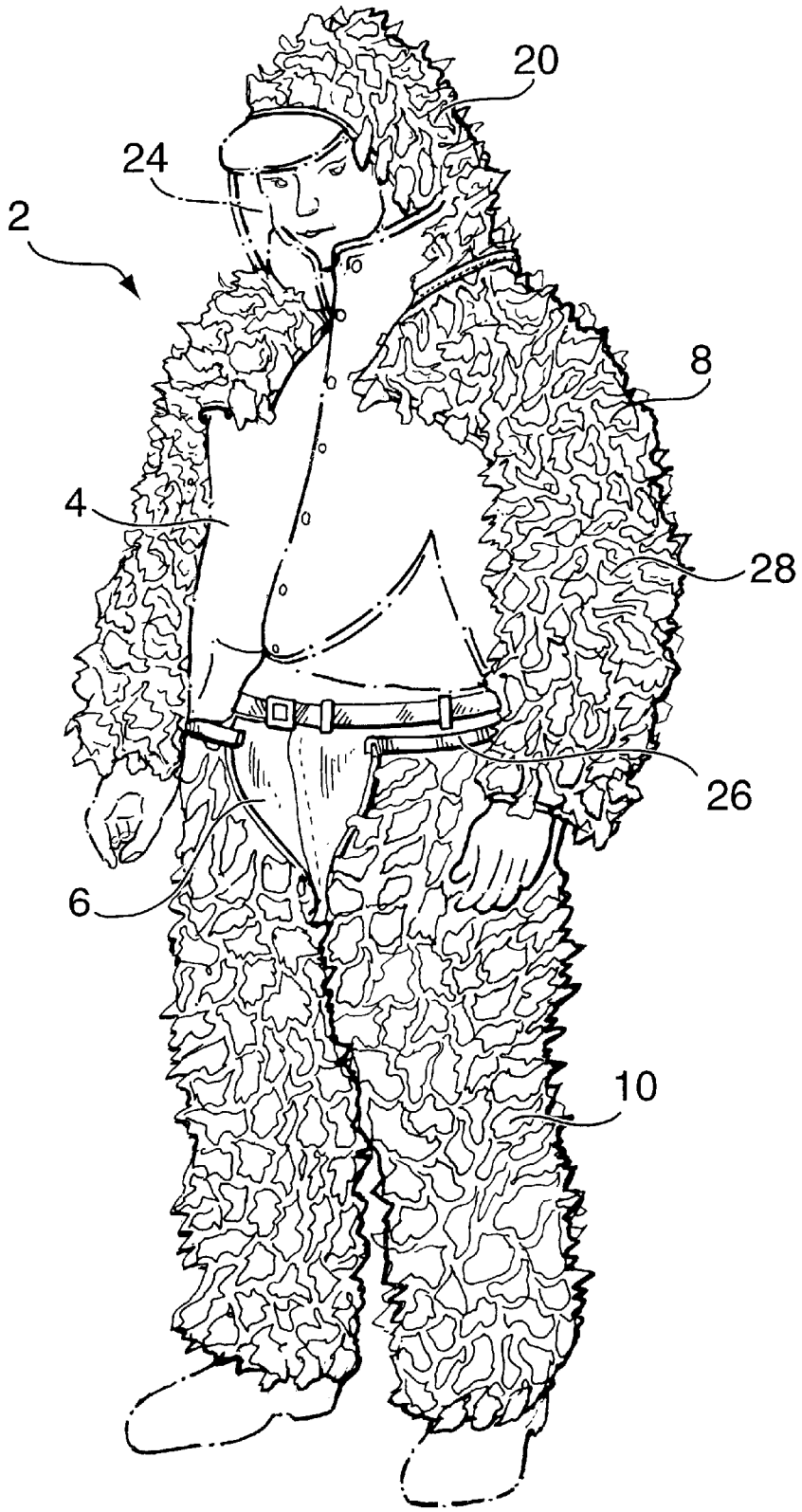
FIG. 1 is a perspective view of a person wearing both a hooded jacket and pants in accordance with the present invention.

While the invention will be described in conjunction with an illustrated embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to FIG. 1 there is illustrated a combination outer garment 2 having hooded jacket 4 and pants 6 in combination with a three dimensional camouflage covering 8 for the hooded jacket and three dimensional camouflage covering 10 for the pants 6, in accordance with the invention. The hooded jacket 4 and pants 6 are conventional jackets and pants and for instance may be of camouflage colour to resemble wooded or bush conditions. The three dimensional camouflage coverings 8 and 10, as can be seen in FIG. 2, comprise a conventional construction of open mesh net base 12 and a plurality of leaf or foliage appendages 14 which simulate leaves or foliage in colour and shape, secured for instance by stitching 16, to base 12.

Figure 2:
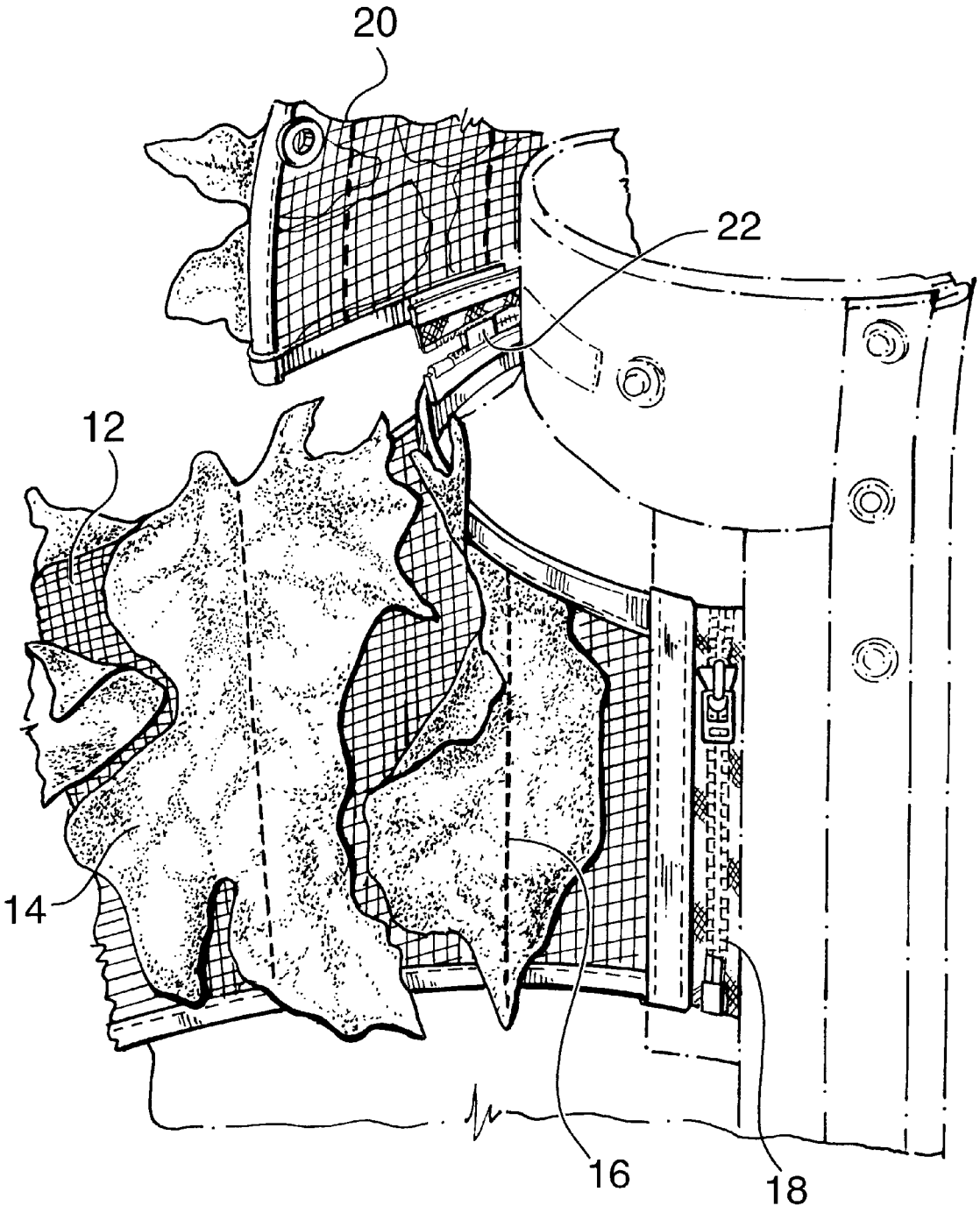
FIG. 2 is an enlarged, partial view of the upper part of the jacket of FIG. 1, illustrating in more detail the garment construction according to the present invention.

Mating zipper means 18, as can be seen in FIG. 2, secure upper portions of camouflage 8 to upper portions of the hooded jacket 4. In this illustrated embodiment, a three dimensional camouflage hood covering 20 is secured to covering 8 by means of a further zipper means 22, so that, when in position, three dimensional camouflage hood cover 20 covers the hood 24 attached to hooded jacket 4.

Also, as can be seen in FIG. 1, zipper means 26 secured to upper portions of three dimensional camouflage covering 10 for pants 6, about the waist portion, and about the waist portion of pants 6, as illustrated, permit releasable attachment of camouflage covering 10 over pants 6. The camouflage coverings 8 and 10 are really like accessories which may optionally be sold with jackets 4 and pants 6 which have been fitted with appropriate zipper portions releasably to receive, the corresponding portions of these camouflage coverings.

Thus, when it is desired to remove camouflage covering 8 and 10 respectively from jacket 4 and pants 6, all that need be done is to unzip the relevant zippers 18 and 22. This camouflage covering 8 may be partial, as illustrated, with sleeves 28 to cover the corresponding sleeves of jacket 4 when in position as illustrated. Although not illustrated, camouflage covering 8 may be a full jacket form including a body portion and sleeves, to correspond to the jacket over which it sits when attached to jacket 4.

Thus, it is apparent that there has been provided in accordance with the invention a combination outer garment and three dimensional camouflage covering that fully satisfies the objects, aims and advantages set forth above. While the invention has been described in conjunction with an illustrated embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

THE EMBODIMENTS OF THE INVENTION IN WHICH AN EXCLUSIVE PROPERTY OR PRIVILEGE IS CLAIMED ARE DEFINED AS FOLLOWS

What I/we claim as my/our invention:

1. In combination, an outer garment;

a three dimensional camouflage covering including an open mesh base and a plurality of appendages to simulate at least one of foliage and leaves; and means secured to said outer garment and to peripheral portions of said covering to releaseably secure said covering to said garment.

2. The combination as set forth in claim 1 wherein said outer garment is a jacket having sleeves and said covering is a jacket having sleeves and a central portion, said sleeves of said covering being sized to receive said sleeves of said outer garment.

3. The combination as set forth in claim 2 wherein said means includes zipper means positioned at upper peripheral portions of said sleeves of said covering and upper portions of said outer garment.

4. The combination as set forth in claim 1 wherein said outer garment is pants having a pair of leg portions and said covering has leg portions sized to receive said leg portions of said outer garment.

5. The combination as set forth in claim 4 wherein said means includes zipper means positioned at upper peripheral portions of said covering and upper portions of said pants.

6. The combination as set forth in claim 1 wherein said outer garment is a hood.

7. A three dimensional camouflage covering comprising an open mesh base;

a plurality of appendages secured to said base to simulate at least one of foliage and leaves; and means secured to peripheral portions of said covering to releaseably secure said covering to a garment.

8. A three dimensional camouflage covering as set forth in claim 7 wherein said base forms a jacket having sleeves and a central portion.

9. A three dimensional camouflage covering as set forth in claim 7 wherein said base forms pants having leg portions.

10. A three dimensional camouflage covering as set forth in claim 7 wherein said base forms a hood.

11. A three dimensional camouflage covering as set forth in claim 7 wherein said means includes zipper means positioned at peripheral portions of said base.

* * * * *